US005273402A

United States Patent [19]

Maury

[11] Patent Number: 5,273,402

[45] Date of Patent: Dec. 28, 1993

[54] PORTABLE CEILING FAN ASSEMBLY AND MOUNTING ASSEMBLY THEREFOR

[76] Inventor: Nicol R. Maury, 233 S. Batavia Ave., Batavia, Ill. 60510

[21] Appl. No.: 56,576

[22] Filed: Apr. 30, 1993

Related U.S. Application Data

[63] Continuation of Ser. No. 876,767, May 1, 1992, abandoned.

[51] Int. Cl.[5] ..... B64C 11/14

[52] U.S. Cl. ..... 416/246; 416/5; 248/125

[58] Field of Search ..... 416/5, 246; 248/125

[56] References Cited

U.S. PATENT DOCUMENTS

| | | | |
|---|---|---|---|
| D. 48,710 | 3/1916 | Crucet . | |
| D. 111,972 | 11/1938 | Janca . | |
| D. 131,669 | 3/1942 | Kisling . | |
| D. 270,942 | 10/1983 | McCain | D23/158 |
| D. 291,352 | 8/1987 | Kouno et al. | D23/157 |
| D. 297,973 | 10/1988 | Everett, Jr. | D23/377 |
| D. 299,858 | 2/1989 | Davis | D23/379 |
| 2,164,608 | 7/1939 | Cornelius . | |
| 2,681,761 | 6/1954 | Schlumbohm . | |
| 2,857,095 | 10/1958 | Suarez Grau | 416/246 |
| 3,559,935 | 2/1971 | Gardner | 248/125 |
| 4,515,538 | 5/1985 | Shih | 416/246 |
| 5,114,016 | 5/1992 | Todd | 416/246 |

FOREIGN PATENT DOCUMENTS

| | | | |
|---|---|---|---|
| 352051 | 9/1937 | Italy | 416/246 |
| 125097 | 5/1991 | Japan | 248/158 |
| 120291 | 11/1918 | United Kingdom | 248/158 |
| 16253 | 6/1937 | United Kingdom | 248/125 |

*Primary Examiner*—John T. Kwon
*Attorney, Agent, or Firm*—McCaleb, Lucas & Brugman

[57] ABSTRACT

A portable ceiling fan assembly has an upright shaft secured to a base. A fan-supporting bracket is mounted on the shaft. In the embodiment shown, the bracket is C-shaped and has a lower arm extending horizontally and cantileverly from the shaft, and an upper arm extending toward the axis of the shaft. There is a fan-receiving space between the arms. A ceiling type fan is supported at the free end of the upper arm, with the blades of the fan rotatable in the space between the arms, and the rotational axis of the fan is congruent with the upright axis of the shaft.

8 Claims, 3 Drawing Sheets

PORTABLE CEILING FAN ASSEMBLY AND MOUNTING ASSEMBLY THEREFOR

This is a continuation of copending application Ser. No. 07/876,767 filed on May 1, 1992, now abandoned.

BACKGROUND OF THE INVENTION

Ceiling fans typically have four or five blades four or more feet in diameter which rotate at relatively low speeds, and are whisper quiet. They are permanently installed, just below the ceiling where the heated air tends to rise and collect and are quite effective in providing a uniform temperature gradient from floor to ceiling. They reduce heating costs and improve comfort without the noise of conventional small, high speed fans.

Unfortunately, these advantages are generally not available to a person living in a rented or leased home, apartment or office. The lessor usually will not permit permanent modifications of the building and the electrical wiring circuit needed to install a conventional ceiling fan.

There is a need for a portable ceiling fan mounting assembly which can be plugged into an ordinary household or office electrical outlet and can be moved from place to place as needed, without requiring a permanent, fixed installation.

SUMMARY OF THE INVENTION

A general object of this invention is to provide a portable ceiling fan and a mounting assembly therefor which enables a renter or lessee to have all the benefits of a permanently installed ceiling fan without the drawbacks and possible objections which might be raised to a permanent installation.

A particular object of the invention is to provide a portable ceiling fan mounting assembly which has great stability and resistance to tipping by reason of the fact that the rotational axis of the ceiling type fan is near, or preferably congruent with, the upright axis of a vertical support shaft.

An object of the invention is to provide a generally C-shaped, bracket extending cantileverly from an upright shaft secured to a portable base, and a mounting for a ceiling type fan within the C-shaped bracket enabling the blades of the fan to rotate in space between upper and lower arms of the bracket.

Another object is to provide a portable ceiling type fan mounting assembly with a fan-supporting bracket extending laterally from a vertical shaft, the bracket having a lower horizontal arm extending cantileverly from the shaft and an upper horizontal arm having a connection with the lower arm at a position laterally offset from the axis of the shaft, and extending cantileverly from the aforesaid connection toward the axis of the shaft, the two arms being vertically offset to define a fan- receiving space between them, and the free end portion of the upper arm supporting a ceiling type fan with the blades thereof moveable in the space between the arms.

Another object in such a portable ceiling fan mounting assembly is to support the ceiling fan with its rotational axis coinciding with the upright axis of the shaft to provide a compact construction combined with optimum stability and resistance to tipping.

BRIEF DESCRIPTION OF THE DRAWINGS

Other objects and advantages of the invention will be apparent from the following description taken in connection with the accompanying drawings in which:

FIGS. 2 and 3 show an optional safety screen in broken lines;

Like parts are designated by like reference characters throughout the figures of the drawings.

DETAILED DESCRIPTION OF THE PREFERRED EMBODIMENT

Figure 6:
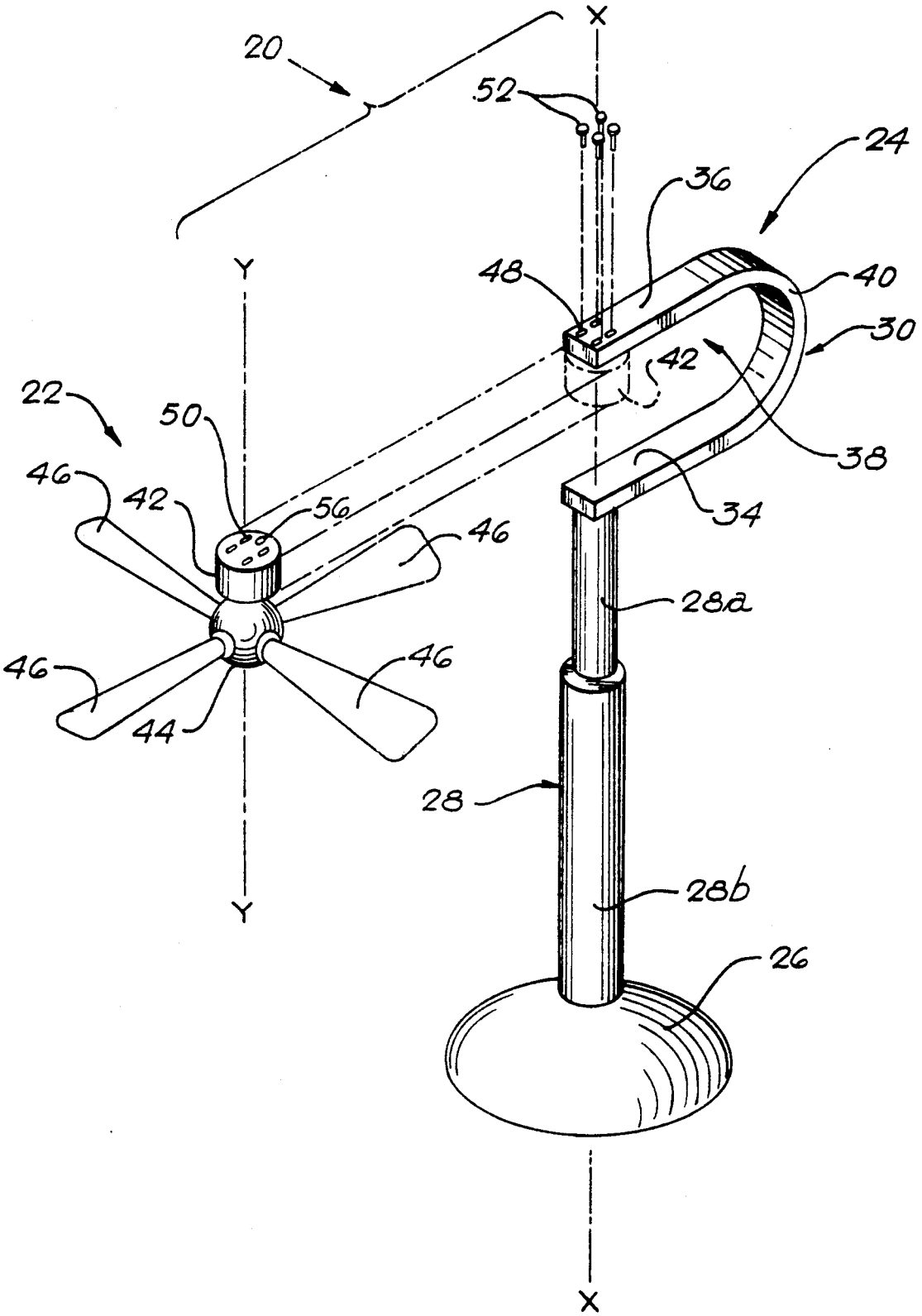
FIG. 6 is a view similar to FIG. 1 showing an exploded view with a typical ceiling fan assembly separated from a portable mounting assembly therefor illustrating one form of the present invention.

Referring now particularly to the drawings, a portable ceiling fan assembly illustrating a preferred form of the present invention is generally designated 20. In the exploded view of FIG. 6 this comprises a ceiling fan assembly 22 and a portable mounting assembly 24 therefor.

The portable mounting assembly comprises a base 26, upright shaft 28 secured to the base, and a cantileverly-offset fan-supporting bracket 30.

The shaft 28 comprises two telescopically assembled sections 28*a* and 28*b* locked at a selected length along upright axis X—X by a set screw 32 which is threadedly engaged with lower shaft section 28*b* and has its inner end portion engaged with the upper shaft section 28*a*.

In the embodiment shown, the fan-supporting bracket 30 is C-shaped. It comprises a first, lower, horizontal arm 34 secured to the top of the shaft section 28*a* and extending laterally and cantileverly therefrom. A second, upper, horizontal arm 36 is upwardly offset from the lower arm sufficiently to define a fan-receiving space 38 between the arms. The bracket has a curved, intermediate section 40 which provides a connection between the arms. The second or upper arm 36 extends laterally and cantileverly from the curved connection 40 toward the shaft axis X—X.

Means is provided at the free end portion of upper arm 36 for connecting the ceiling fan assembly 22 with its rotational axis Y—Y preferably at or near a location of congruency with shaft axis X—X.

The ceiling fan assembly 22 may be any standard off-the-shelf product, or it may be specially made of compact, lightweight construction for portability. As illustrated here, it comprises a low speed electrical motor 42 and a depending rotor 44 with a plurality, in this case four, of blades 46.

One of the important features of the present invention is stability and resistance to tipping because the cantilever construction of the bracket 30 enables the fan assembly to be located with its weight centered over the base 26. It should be supported on the underside of the upper arm 36 in a position where the rotational axis Y—Y of the fan intersects the base 26. Preferably, for maximum stability, the fan assembly should be positioned, as best shown in FIG. 2, where the X—X and Y—Y axes are vertical and congruent.

The upper arm 36 has four bolt holes 48 in registration with four screw-tapped holes 50 in the top end the electric motor 42. The motor is held in place by of bolts 52 extending through holes 48 into the tapped openings 50 in the motor.

The motor 42 may be energized in any suitable way, preferably by means of a conductor (not shown) extending through the hollow base 26, shaft 28, bracket 24 and an opening 56 (FIG. 6) in the motor.

Figure 1:
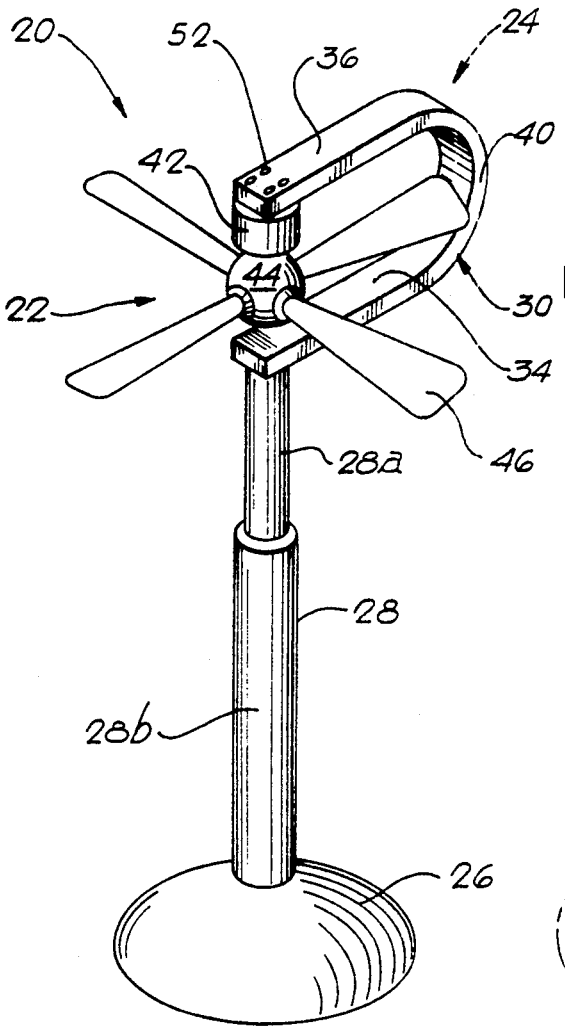
FIG. 1 is a perspective view of a portable ceiling fan assembly illustrating a preferred form of the invention.
Figure 3:
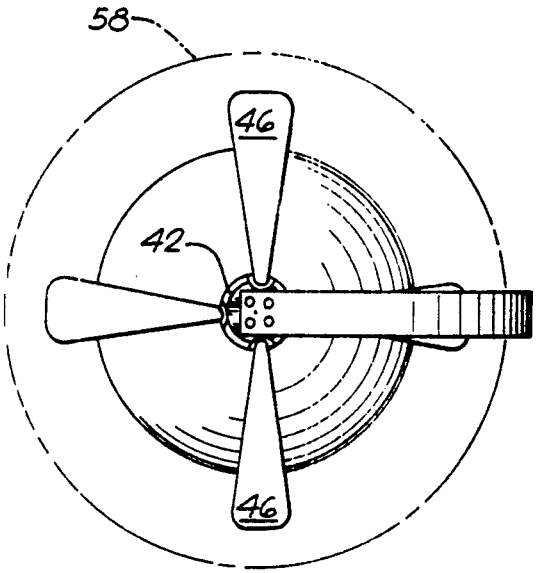
FIG. 3 is a top view thereof.
Figure 2:
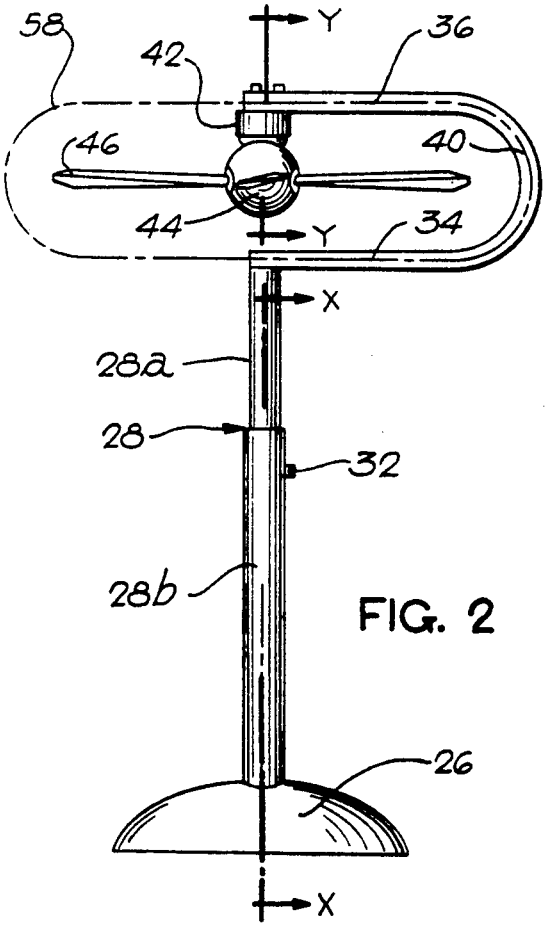
FIG. 2 is a right side view thereof.
Figure 4:
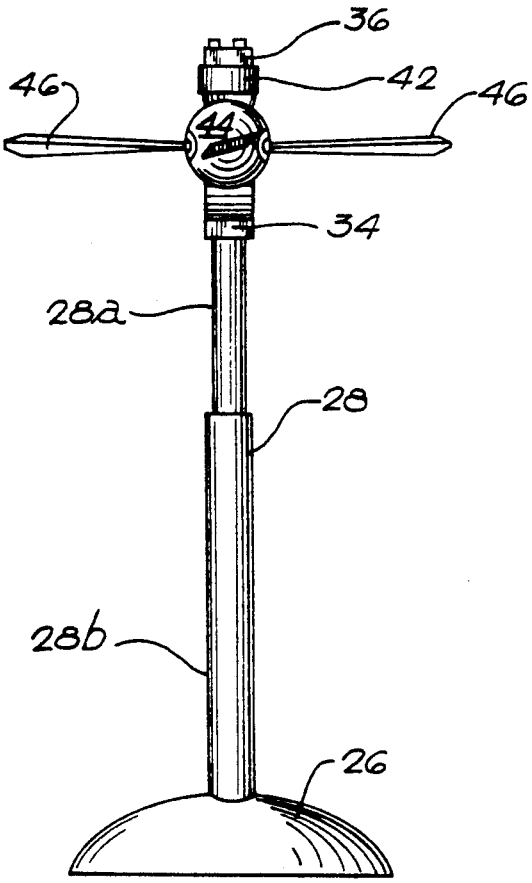
FIG. 4 is a front view thereof.
Figure 5:
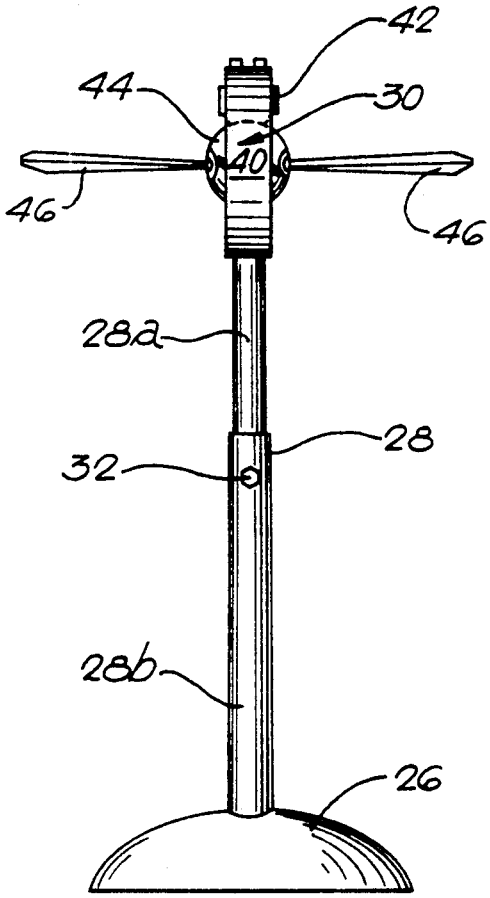
FIG. 5 is a rear view thereof.

Referring to FIGS. 2 and 3, an optional guard screen or cage 58 may be fastened by bolts (not shown), or otherwise, to the bracket 30, to prevent a person accidentally contacting the rotating fan blades.

While a particular example of the present invention has been shown and described, it will be apparent that changes and modifications may be made without departing from the invention in its broadest aspects. The aim of the appended claims, therefor, is to cover all such changes and modifications as fall within the spirit and scope of the invention.

The embodiments of the invention in which an exclusive property or privilege is claimed are defined as follows:

1. A portable ceiling fan assembly comprising:

a base;

upright shaft means secured to the base and extending upwardly along a vertical axis;

a generally C-shaped fan-supporting bracket having upper and lower horizontal arms spaced vertically apart and a fan-receiving space between the arms, the inner end of the lower of said arms being secured to the top of the shaft means, with both of said arms being offset laterally outward from the vertical axis of the shaft means, a connection between said arms being laterally outwardly offset from said vertical axis at the outer ends of said arms, said bracket having an open inner side along vertical axis communicating with said fan-receiving space; and a ceiling type fan rigidly immovably supported by the inner end portion of the upper arm with the blades of the ceiling type fan rotatable about a fixed vertical rotational axis intersecting said inner end portion of the upper arm and movable through the fan-receiving space and the open side, and with the axis of the fan aligned substantially with the vertical axis of the shaft means.

2. A portable ceiling fan assembly according to claim 1 including a cage supported on said bracket and completely surrounding the blades of the fan to provide a guard therefor.

3. A portable ceiling fan assembly comprising:

a base;

an upright shaft secured to the base and extending upwardly along an upright axis;

a fan-supporting bracket including first and second vertically spaced, elongated arms extending laterally outwardly from said upright axis, an inner end of said first arm secured to the top of the shaft and extending cantileverly outwardly therefrom, an outer end of said second arm having a connection with an outer end of said first arm at a position laterally offset from said axis, said second arm extending cantileverly from said connection inwardly toward said axis and being offset upwardly from said first arm to define a fan-receiving space between the arms, the inner end of said second arm terminating substantially at said upright axis, said space having an open side between said inner ends of said first and said second arms;

a ceiling type fan rigidly, unmovably mounted on said inner end of said second arm remote from said connection, said fan having blades in said space which are rotatable about a fixed vertical axis through said space and said open side; and said connection being laterally outwardly spaced from said upright axis sufficiently to provide clearance for the blades of the ceiling type fan.

4. A portable fan assembly according to claim 3 in which the rotational axis of the fan coincides with the upright axis of the shaft.

5. A portable ceiling fan assembly according to claim 4 in which said arms are in vertically spaced parallel relationship to one another.

6. A portable ceiling fan assembly comprising:

a base;

upright shaft means secured to the base and extending upwardly along a vertical axis;

a generally C-shaped fan-supporting bracket having upper and lower arms spaced vertically apart and a fan-receiving space between the arms, an inner end portion of the lower of said arms being secured to the top of the shaft means, with both of said arms extending laterally outwardly from said vertical axis, a connection between said arms being laterally offset from said vertical axis at the outer ends of said arms, said bracket having an open inner side along said vertical axis communicating with said fan-receiving space;

a ceiling type fan rigidly immovably mounted on the inner end of the upper arm at said vertical axis and having blades rotatable about a fixed vertical rotational axis;

means above the shaft means at the inner end portion of the upper arm supporting the ceiling-type fan with the fan blades mounted for rotation through said space and said open side; and said connection being laterally outwardly spaced from said upright axis sufficiently to provide clearance for the blades of the ceiling type fan.

7. A portable ceiling fan assembly according to claim 6 in which the rotational axis of the fan substantially coincides with the vertical axis of the shaft means.

8. A portable ceiling fan assembly according to claim 6 in which the shaft means comprises telescopical tubes with means for locking the tubes together to support the bracket at a selected height above the base.

* * * * *